US009702072B2

(12) United States Patent
Firth et al.

(10) Patent No.: US 9,702,072 B2
(45) Date of Patent: Jul. 11, 2017

(54) HANDHELD FELTING DEVICE

(71) Applicants: Harry Firth, Stillwater, MN (US); Robbin Firth, Stillwater, MN (US)

(72) Inventors: Harry Firth, Stillwater, MN (US); Robbin Firth, Stillwater, MN (US)

( * ) Notice: Subject to any disclaimer, the term of this patent is extended or adjusted under 35 U.S.C. 154(b) by 489 days.

(21) Appl. No.: 13/912,573

(22) Filed: Jun. 7, 2013

(65) Prior Publication Data

US 2013/0340218 A1 Dec. 26, 2013

Related U.S. Application Data

(60) Provisional application No. 61/690,236, filed on Jun. 22, 2012.

(51) Int. Cl.
*D04H 17/00* (2006.01)
*D06C 11/00* (2006.01)

(52) U.S. Cl.
CPC ..... *D06C 11/00* (2013.01); *D04H 17/00* (2013.01)

(58) Field of Classification Search
CPC ..... D04H 17/00; D06C 11/00; D06C 23/00; D06C 23/02; D06C 19/00; D06C 17/04; D06C 17/00; D06C 23/04; D06C 2700/29; D06C 2700/15; A47L 25/08; A47L 13/02; A47L 13/022; A47L 13/10; A22C 9/007; A47J 37/0611; A01K 13/001; A01K 13/002; D06F 75/38; D06F 75/30; D01G 33/00
USPC ..... 26/27, 28; 15/160, 110, 104.002; 119/621; 99/372; 452/146; D7/682; 38/93; 69/20
See application file for complete search history.

(56) References Cited

U.S. PATENT DOCUMENTS 739,813 A * 9/1903 Beardsley ..... A47L 25/005 15/104.001
D48,170 S * 11/1915 Colley ..... 452/146
D57,334 S * 3/1921 Hanford ..... D7/682
1,401,719 A * 12/1921 Myers ..... D06C 11/00 15/210.1
1,436,921 A * 11/1922 Stanley ..... D06C 11/00 26/31
1,493,444 A * 5/1924 Burch ..... A47J 37/0611 99/375
1,598,338 A * 8/1926 Blaine, Jr. ..... D06C 11/00 26/31
1,987,390 A * 1/1935 Davis ..... A61H 7/003 15/244.4
2,008,260 A * 7/1935 Reineman ..... D06C 11/00 15/230.17
D104,360 S * 5/1937 Wagner ..... 452/146
2,314,711 A * 3/1943 Kelly ..... A47L 13/38 15/221

(Continued)

FOREIGN PATENT DOCUMENTS

CH 706643 A2 * 12/2013

*Primary Examiner* — Amy Vanatta
(74) *Attorney, Agent, or Firm* — Dicke, Billig & Czaja, PLLC

(57) ABSTRACT

A device used for felting. The felting device may include a top portion and a bottom portion. The bottom portion may include a bottom surface with a waffle maker pattern. The waffle maker pattern may include a plurality of intersecting grooves that form protruding blocks. The top portion may include a handle for easily grasping and using the felting device.

16 Claims, 2 Drawing Sheets

(56) References Cited

U.S. PATENT DOCUMENTS 2,423,963 A * 7/1947 Coffman ..... A47J 37/0611 99/349
2,445,444 A * 7/1948 Mainwold ..... D06C 23/00 38/93
2,471,787 A * 5/1949 Smith ..... C14B 1/48 407/29.15
2,571,573 A * 10/1951 Henrard ..... A01J 15/00 165/180
D174,913 S * 6/1955 Marcus ..... 452/146
3,100,312 A * 8/1963 Williams ..... A47L 23/24 15/215
3,330,077 A * 7/1967 Foster ..... A46B 15/00 15/104.002
3,363,276 A * 1/1968 Thomas, Jr. ..... A47L 25/005 15/104.002
3,408,709 A * 11/1968 Reitz ..... D06C 29/00 26/1
3,712,659 A * 1/1973 Kneissl ..... A63B 29/08 16/421
4,055,029 A * 10/1977 Kalbow ..... A47L 13/16 451/527
4,089,523 A * 5/1978 Newburger ..... A63B 51/015 473/553
4,595,622 A 6/1986 Schaefer
4,989,864 A * 2/1991 Ubl ..... A63B 51/015 473/553
5,296,289 A * 3/1994 Collins ..... D04H 3/14 26/51
5,310,181 A * 5/1994 Chan ..... A63B 51/015 473/553
5,551,960 A * 9/1996 Christianson ..... A47L 13/28 51/295
5,626,099 A * 5/1997 Staller ..... A01K 13/00 119/600
5,806,135 A * 9/1998 Earle ..... A47L 13/16 15/104.001
5,844,518 A * 12/1998 Berg ..... H01Q 17/008 342/2
6,226,811 B1 * 5/2001 Fagan ..... A47K 7/024 15/207.2
7,430,790 B1 10/2008 Bowles et al.
7,862,408 B1 * 1/2011 Weinstein ..... A22C 9/007 452/102
2004/0226577 A1 * 11/2004 Schaaf ..... A47L 13/16 134/6
2010/0125961 A1 * 5/2010 Tuman ..... A47L 13/00 15/160
2013/0045654 A1 2/2013 von der Fecht
2013/0255047 A1 10/2013 Sasur

* cited by examiner

HANDHELD FELTING DEVICE

CROSS-REFERENCE TO RELATED APPLICATION

This application claims the benefit of priority of U.S. provisional application No. 61/690,236, filed Jun. 22, 2012, the contents of which are herein incorporated by reference.

BACKGROUND OF THE INVENTION

The present invention relates to a felting device and, more particularly, to a felting device with a waffle maker pattern on the bottom surface.

Felt is made by a process called wet felting where the natural wool fibers, stimulated by friction and lubricated by moisture (usually soapy water), move at a 90 degree angle towards the friction source and then away again, in effect making little "tacking" stitches. While at any given moment only 5% of the fibers are active, the process is continual, so different 'sets' of fibers become activated and then deactivated, thereby building up the cloth. However, the devices used for felting may be difficult to use and may take a long amount time to perform the felting process.

As can be seen, there is a need for a felting device that may be quick and easy to use.

SUMMARY OF THE INVENTION

In one aspect of the present invention, a felting device comprises: a top portion comprising a top surface; and a bottom portion comprising a bottom surface, wherein the bottom surface comprises a plurality of intersecting grooves defining a plurality of blocks.

In another aspect of the present invention, a method of felting comprises: providing a felting device comprising: a top portion comprising a top surface; and a bottom portion comprising a bottom surface, wherein the bottom surface comprises a plurality of intersecting grooves defining a plurality of blocks; providing a piece of fabric; and rubbing a piece of fabric with the bottom surface of the felting device.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device used for felting. The felting device may include a top portion and a bottom portion. The bottom portion may include a bottom surface with a waffle maker pattern. The waffle maker pattern may include a plurality of intersecting grooves that form protruding blocks. The top portion may include a handle for easily grasping and using the felting device.

The present invention may include a felting device that combines needle feltings, wet felting roving and silk together. The felting device of the present invention may be a palm wash board. The palm washboard may be hand made out of native hard wood for needle wet felted roving to a silk clothing article, such as a scarf. The felting device of the present invention facilitates a quicker and easier method of felting compared to other devices. There is no rapping or rolling needed.

Figure 1:
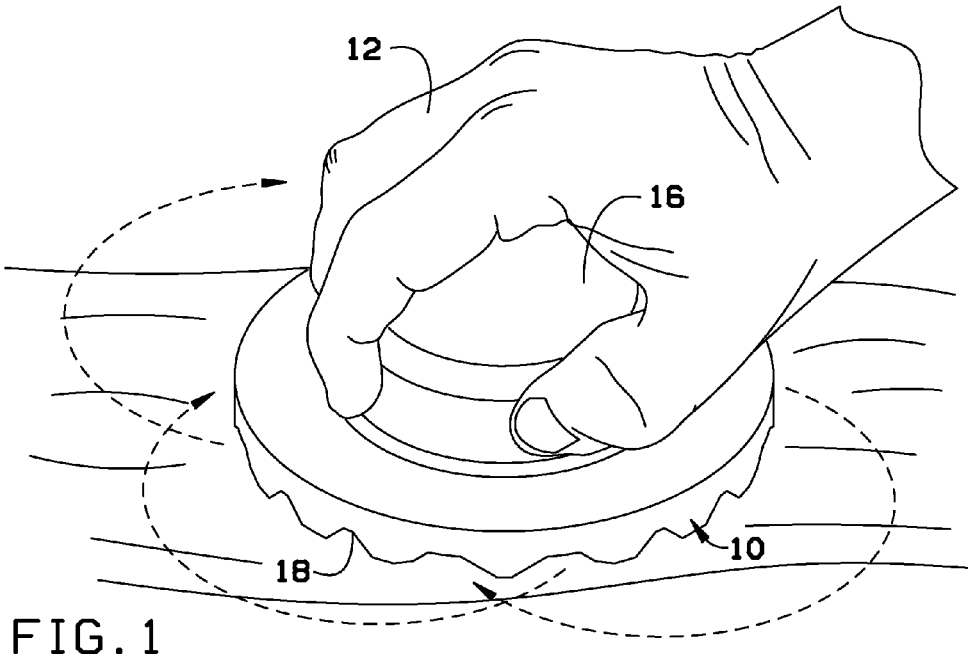
FIG. 1 is a perspective view of an embodiment of the present invention shown in use.
Figure 2:
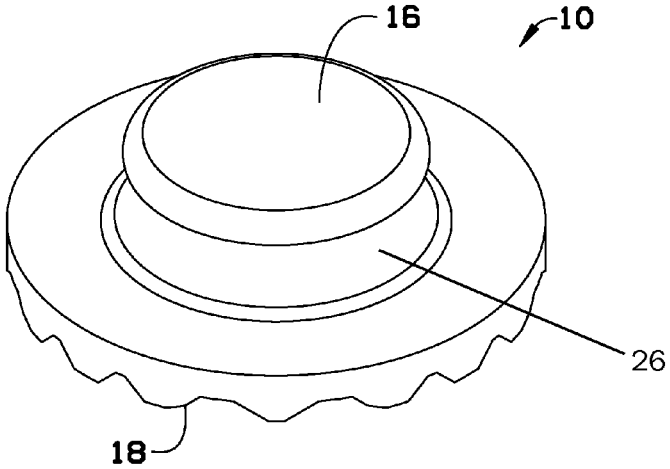
FIG. 2 is a top perspective view of the embodiment of FIG. 1.

Referring to FIGS. 1 through 5, the present invention may include a felting device 10. The felting device 10 may be a circular shape, similar to a puck. However, the felting device may be in any suitable shape, such as square shaped, triangular shaped, and the like. The felting device may include a top portion having top surface 24 and a bottom portion having a bottom surface 22. The top portion may be used to grasp the felting device 10. In certain embodiments, the top portion may include handle 16. In certain embodiments, the handle 16 may protrude from the top surface 24 and may include a ridge 26 at least partially around the circumference for a user to easily grasp the felting device 10. As illustrated in FIG. 1, an exemplary operator 12 may grasp the felting device 10 by the handle 16 during use.

Figure 3:
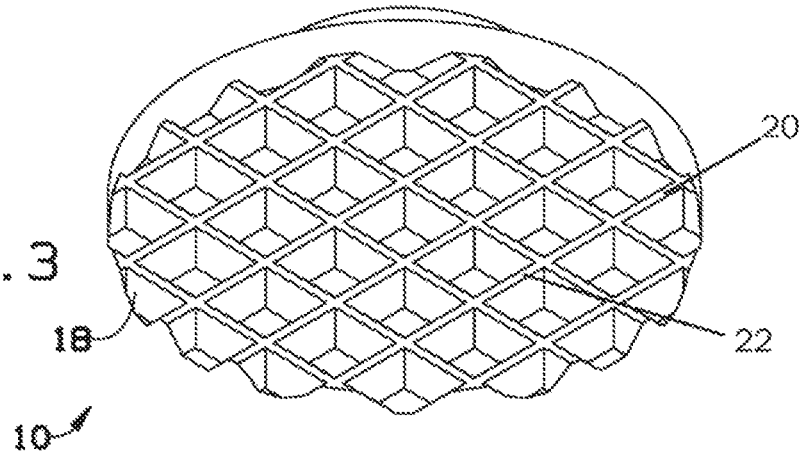
FIG. 3 is a bottom perspective view of the embodiment of FIG. 1.
Figure 4:
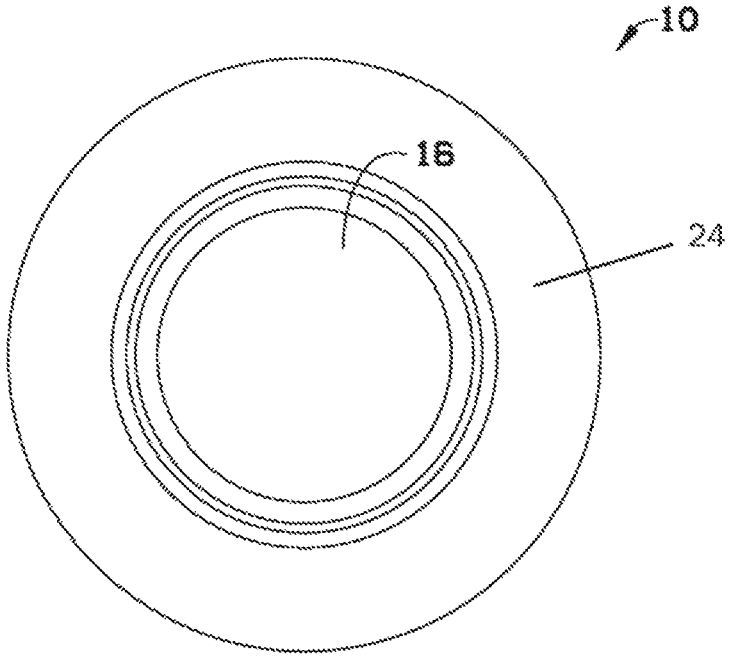
FIG. 4 is a top view of the embodiment of FIG. 1.
Figure 5:
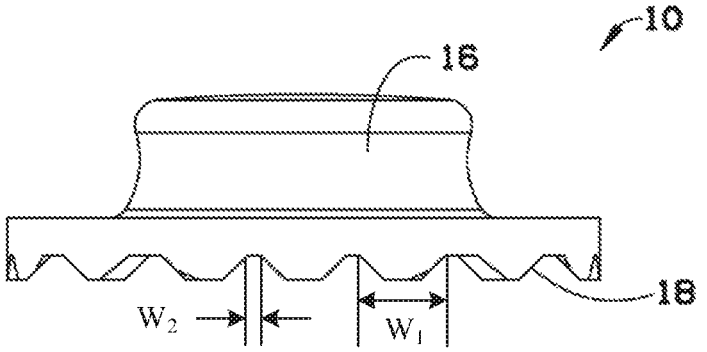
FIG. 5 is a side view of the embodiment of FIG. 1.

The bottom surface 22 of the present invention may have a waffle maker pattern. As illustrated in FIG. 3, the waffle maker pattern may include a plurality of intersecting grooves 20 defining plurality of protruding blocks 18, such as waffle teeth. The protruding blocks 18 may be in any desired shape. However, in certain embodiments, the blocks may have a pyramid shape with a substantially flat top. As can be seen in FIGS. 3 and 5, the plurality of protruding blocks 18 can form the majority of the bottom surface. The plurality of intersecting grooves 20 may include a first set of grooves 20 that is substantially parallel to one another and a second set of grooves 20 that is substantially parallel to one another. The first set of grooves 20 intersects and is substantially perpendicular with the second set of grooves 20. With further reference to FIG. 5, each of the plurality of protruding blocks 18 can have a first width $W_1$ greater than a second width $W_2$ of each of the plurality of intersecting grooves 20.

A method of making the present invention may include the followings. About a 5×5 inch monolithic piece of rigid material, for example, wood, such as maple, cedar, ash, walnut, cherry and the like may be ascertained. The piece of wood may be about 1 and ¾ inches thick. A router and ½ inch groove bit may be used, such that protruding blocks 18 having approximately a ½ inch height may be formed, to create the waffle pattern on the bottom surface 22. About a 4 and ¾ to about a 5 inch circle may be cut out of the 5 inch block. Then using a lathe, the piece may be designed to include about a 2 to about a 2 and ½ inch handle 16 protruding from the top surface 24. The device may then be coated with a two part epoxy finish.

A method of using the present invention may include the following. First an operator 12 may provide a piece of fabric 14. Then the operator 12 may rub the piece of fabric 14 with the bottom surface of the felting device 10 to create the felt. The rubbing may be in a circular motion, a straight line or the like.

It should be understood, of course, that the foregoing relates to exemplary embodiments of the invention and that modifications may be made without departing from the spirit and scope of the invention as set forth in the following claims.

What is claimed is:

1. A felting device comprising:

a top portion comprising a top surface and a handle protruding from the top surface, the handle including a curved upper surface and a concave side surface, the concave side surface extends around a perimeter of the handle between the top surface and the curved upper surface, wherein the curved upper surface of the handle is configured to accommodate a palm of a user's hand and the concave side surface is configured to accommodate fingertips of the user's hand; and a bottom portion comprising a bottom surface, wherein the bottom portion is formed of a monolithic, rigid material, wherein the bottom surface comprises a plurality of intersecting grooves defining a plurality of protruding blocks, wherein the plurality of protruding blocks forms the majority of the bottom surface, and wherein each of the plurality of protruding blocks is in the shape of a pyramid with a substantially flat top surface.

2. The felting device of claim 1, wherein the plurality of intersecting grooves comprises a first set of grooves substantially parallel to one another and a second set of grooves substantially parallel to one another, wherein the first set of grooves intersects and is substantially perpendicular with the second set of grooves.

3. The felting device of claim 1, further comprising an outer layer comprising an epoxy finish.

4. The felting device of claim 1, wherein each of the plurality of protruding blocks has a first width greater than a second width of each of the plurality of intersecting grooves.

5. The felting device of claim 1, wherein at least the bottom portion is formed of wood.

6. The felting device of claim 1, wherein each of the plurality of protruding blocks has a height of approximately ½ inch.

7. The felting device of claim 1, wherein the plurality of protruding blocks and the plurality of intersecting grooves extend across an entirety of the bottom surface.

8. The felting device of claim 1, wherein a first perimeter of the top portion is circular and a second perimeter of the bottom portion is circular.

9. A felting device, comprising:

a top portion having a top surface, wherein the top portion includes a handle, wherein the handle includes a curved upper surface and a concave side surface, the concave side surface extends around a perimeter of the handle between the top surface and the curved upper surface, and wherein the curved upper surface of the handle is configured to accommodate a palm of a user's hand and the concave side surface is configured to accommodate fingertips of the user's hand; and a bottom portion having a bottom surface, wherein the bottom surface includes a plurality of protruding blocks and a plurality of grooves extending between the plurality of protruding blocks, wherein the plurality of protruding blocks are pyramidal with substantially planar top surfaces, wherein each of the plurality of protruding blocks have a height of approximately ½ inch.

10. The felting device of claim 9, wherein the handle comprises a groove at least partially around the circumference of the handle.

11. The felting device of claim 9, wherein the top portion and the bottom portion are formed of the same material.

12. The felting device of claim 9, wherein the plurality of grooves have a uniform width.

13. The felting device of claim 9, wherein each of the plurality of protruding blocks has a width greater than a width of each of the plurality of intersecting grooves.

14. The felting device of claim 9, wherein a first perimeter of the top portion is circular and a second perimeter of the bottom portion is circular.

15. The felting device of claim 9, wherein the bottom portion includes a perimeter side surface extending between the bottom surface and the top surface, wherein the plurality of protruding blocks and plurality of grooves extend across the bottom surface to intersect with the perimeter side surface, and wherein a side surface of each of the plurality of the protruding blocks intersecting with the perimeter side surface is defined by the perimeter side surface.

16. The felting device of claim 9, wherein at least the bottom portion is formed of wood.

* * * * *